United States Patent [19]

Knox

[11] 4,248,469

[45] Feb. 3, 1981

[54] LIFTING HARNESS

[76] Inventor: Norman C. Knox, Rt. 1, Box 906, Queen Creek, Ariz. 85242

[21] Appl. No.: 56,336

[22] Filed: Jul. 10, 1979

[51] Int. Cl.[3] ..... B66C 1/14

[52] U.S. Cl. ..... 294/78 A

[58] Field of Search ..... 294/74, 78 R, 78 A, 294/82 R; 24/116 R, 116 A, 128 R, 230.5 R; 59/93

[56] References Cited

U.S. PATENT DOCUMENTS

| | | | |
|---|---|---|---|
| 569,448 | 10/1896 | Dudley | 294/82 R |
| 1,326,969 | 1/1920 | Rounds | 294/78 A |
| 1,512,149 | 10/1924 | Wagner | 294/78 R |
| 2,820,661 | 1/1958 | Koons et al. | 294/78 R |
| 3,335,468 | 8/1967 | Harley | 24/116 R X |
| 3,741,599 | 6/1973 | Drayton | 294/82 R |

FOREIGN PATENT DOCUMENTS

| | | | |
|---|---|---|---|
| 1404546 | 5/1965 | France | 294/78 A |
| 1135182 | 12/1968 | United Kingdom | 294/78 A |

*Primary Examiner*—Johnny D. Cherry

*Attorney, Agent, or Firm*—Cahill, Sutton & Thomas

[57] ABSTRACT

An improved lifting harness includes a thick metal plate having an upper hole for attaching the lifting harness to a support. A second hole is disposed in the plate beneath the upper hole. First and second elongated slots through the plate material extend generally downward from the edge of the lower hole. A first heavy chain has one link disposed in the first slot. A lifting hook is hingeably attached to one end of the first chain, and a clevis is hingeably attached to the opposite end of the chain. A link of a second chain is disposed in the second slot. A second hook is hingeably attached to one end of the second chain and a second clevis is hingeably attached to the opposite end of the second chain.

2 Claims, 5 Drawing Figures

LIFTING HARNESS

BACKGROUND OF THE INVENTION

1. Field of the Invention

The invention relates to lifting harnesses including receiving slots for receiving and retaining links for load bearing chains.

2. Description of the Prior Art

Various harnesses and the like have been utilized to connect pulley assemblies, block and tackle assemblies, cranes and the like to heavy objects in order to enable the heavy objects to be lifted. For example, in order to overhaul automobile engines, it is ordinarily necessary to carefully "pull" the engine by disconnecting the engine mounts and attaching a crane assembly or the like to the engine by means of hooks or clevises bolted to pre-existing engine bolt holes in order to lift the engine out of the engine compartment, and later to lower the engine into the engine compartment to reinstall the engine. Many of the prior devices used to lift automobile engines and other heavy objects have been improvised and are highly unsafe. Their use has resulted in numerous serious injuries to individuals working in the vicinity of the engine. Although there is often a need for the heavy object being lifted or lowered to be precisely aligned or oriented in some fashion, many of the prior devices make it difficult to precisely align or orient the heavy object being lifted or lowered. Thus, there is a need for a safe, economical device which can be conveniently and readily attached to an automobile engine or other heavy object to enable a crane or the like to precisely align or orient the heavy object and to safely and quickly lift or lower the heavy object.

Accordingly, it is an object of the invention to provide a safe, convenient, easily used lifting harness for connecting a heavy object to be lifted to a crane or the like.

One known prior device includes an elongated steel plate having an upper hole and a lower hole. A hook from a crane, pulley system or the like is inserted through the upper hole to support the plate. An elongated slot extends vertically from the lower edge of the lower hole. The lower hole is sufficiently large that a heavy lifting chain can be passed therethrough. An elongated slot extends vertically downward from the lower edge of the lower hole. The elongated slot has sufficient length and width that both opposed loop sides of any particular link of the chain can be loosely fitted into and contained within the elongated slot. The elongated slot is sufficiently narrow that the two adjacent chain links engaging opposite ends of the particular chain link are prevented from being pulled through the elongated slot. Ordinarily, suitable end connectors, such as hooks or clevises, are attached to the ends of the two segments of the chain extending downward on opposite sides of the steel plate from the particular chain link placed in the elongated slot. The hooks or clevises are hooked to or bolted to the object to be lifted, the particular link of the chain to be placed in the elongated slot being selected to adjust the segments of the chain to suitable lengths. However, the described device is often inconvenient to use because, for example, clevises might be needed to attach the chain segments to the particular object to be lifted, but the available chain segments have hooks attached thereto. This necessitates locating another lifting harness having the desired clevises or laboriously replacing and removing the hooks and replacing them with clevises. Further, precise adjustment of the lengths of the two above mentioned segments of the chain is often unduly coarse and imprecise because shortening the length of one segment automatically results in lengthening the other segment.

Accordingly, yet another object of the invention is to provide a lifting harness which avoids the need for replacement of end connectors for accomplishment of different lifting tasks.

Still another object of the invention is to provide a lifting harness which provides a greater degree of flexibility and precision in adjusting lengths of segments of chain than the known lifting harnesses.

SUMMARY OF THE INVENTION

Briefly described, and in accordance with one embodiment thereof, the invention provides a lifting harness which includes a very high strength plate having an upper connecting hole and a lower chain accommodating hole therein and first and second lift chains each having a hook and a clevis attached to its opposite ends.

In a described embodiment of the invention, the upper connecting hole is circular and has a diameter sufficiently large to allow a lift hook from a crane or block and tackle assembly to pass therethrough to support the lifting harness. The lower chain accommodating hole includes a circular opening having a sufficiently large diameter to allow one lift chain at a time to pass through. Two symmetrically positioned elongated slots extend downwardly from the lower edge of the circular opening portion of the lower chain accommodating hole. The lengths and widths of the elongated slots are such that opposed sides of one loop of any particular link of each of the lift chains can fit within that elongated slot. The width of each slot is sufficiently small that adjacent links of the link in the slot cannot pass through the slot. The lift chain therefore is retained in the slot. The described device is especially useful for lifting and lowering automobile engines out of and into engine compartments conveniently and safely, since the lifting harness has both clevises and hooks readily available for engaging eyelets or bolts of the engine. The length of one segment of chain extending from the elongated slot of the steel plate to a connecting point of the engine can be varied by the length of a chain link without affecting the length of the chain segment of the other chain, which supports a different point of the object to be lifted. This enables the user to fairly precisely control the orientation of the object as it is lifted or lowered.

DESCRIPTION OF THE INVENTION

Figure 1:
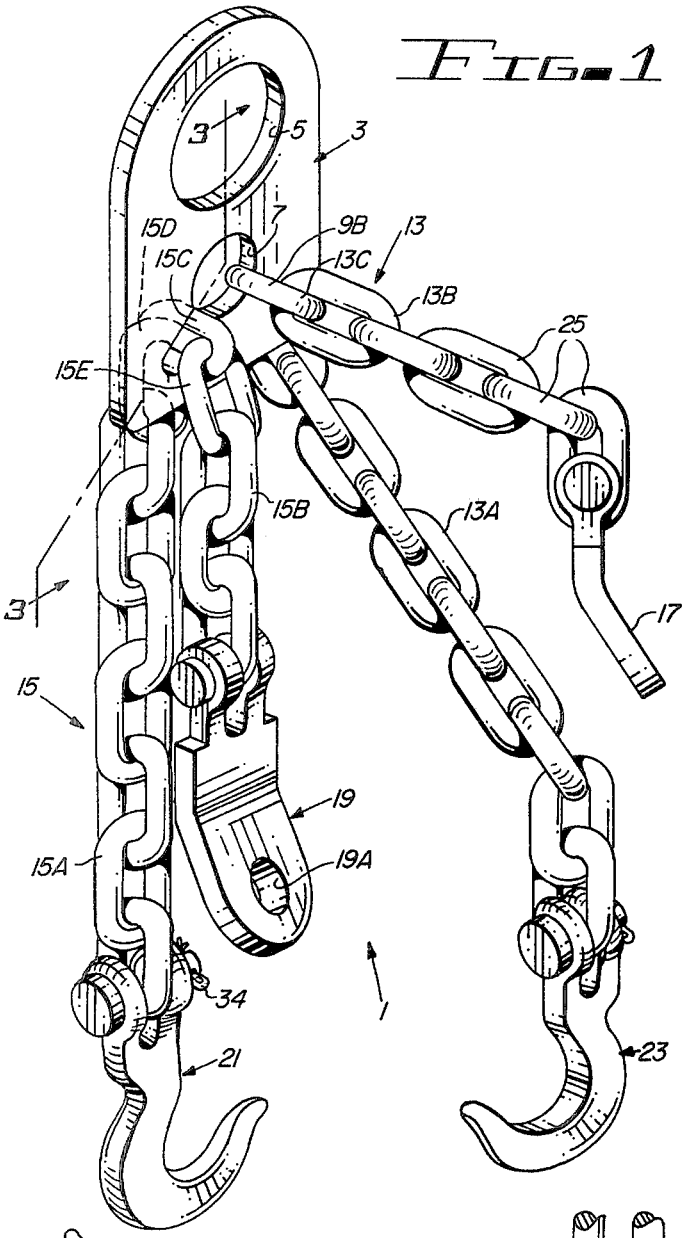
FIG. 1 is a perspective view of the lifting harness of the present invention.

Referring now to the drawings, lifting harness 1 includes steel support plate or chain support 3 and chains 13 and 15. Each of the chains has connected to its respective opposed ends a hook and a clevis as explained subsequently.

Figure 2:
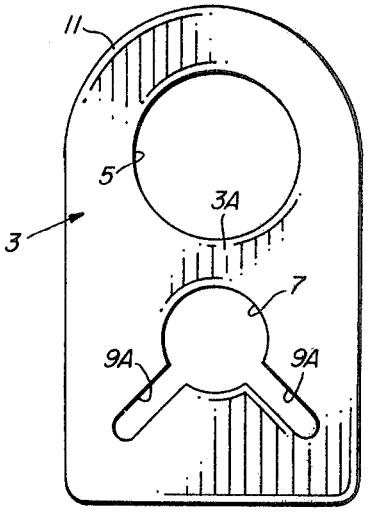
FIG. 2 is a side view of the chain support plate of the lifting harness of FIG. 1.
Figure 3:
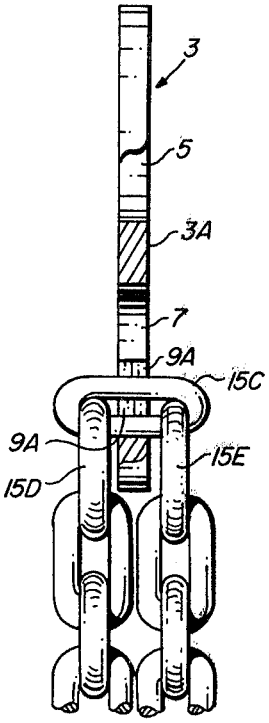
FIG. 3 is a partial cutaway side section view of the lifting harness of FIG. 1.

The configuration of the support plate 3 is best described with reference to FIG. 2 wherein it is seen that steel chain support plate 3 has a generally rectangular configuration with an upper rounded end 11. An upper hole 5 disposed adjacent the upper end of chain supporting plate 3 performs the function of receiving a support member, such as a hook of a crane or block and tackle assembly or the like.

Chain support plate 3 also includes a lower chain receiving hole 7, which includes a generally circular opening having a sufficiently large diameter to allow passage of either chain 13 or chain 15, as subsequently explained. Chain receiving slots 9A and 9B into each of which any particular links of chains 15 and 13, respectively, can be securely but loosely fitted are clearly illustrated in FIG. 1.

Referring particularly to FIG. 1, each of chains 15 and 13 includes a plurality of ordinary generally oval steel links. For example, chain 13 includes a plurality of links 25, each of which consists of a closed loop which is roughly oval in shape. One of the links of chain 15, for example link 15C, is placed in link receiving slot 9A of chain support plate 3. The width of link receiving slot 9A is such that the opposed major sides of link 15C readily fit into elongated slot 9A, but neither of adjacent links 15D or 15E can be pulled laterally through link receiving slot 9A. The depth of elongated slot 9A is approximately equal to the width of link 15C. Similarly, 13C or any other selected link of chain 13, fits into elongated slot 9B in the manner described above. Thus, chains 13 and 15 are securely retained by slots 9B and 9A, respectively.

It can readily be seen that the diameter of the circular portion of chain support opening 7 needs to be sufficiently large that either of chains 13 and 15 can be lifted to remove one of its links from one of the link receiving slots, enabling the user of lifting harness 1 to laterally shift the chain so that a different link can be placed within the link receiving slot. Or, the user can entirely remove the chain from chain support opening 7. In order to accomplish this it is desirable that the diameter of the circular portion of chain support opening 7 be sufficiently large that either the clevis or the hook (attached to the respective opposed ends of that chain) can be drawn through chain support opening 7. This permits the direction of the chain to be reversed, which allows the load lifted by lifting harness 1 to exert approximately symmetrical forces on chain supporting plate 3.

Figure 4:
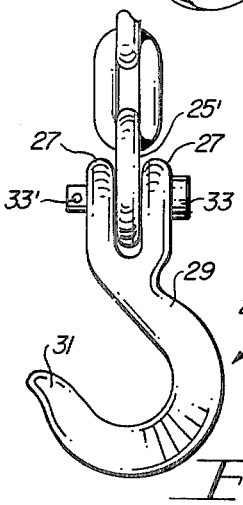
FIG. 4 is a partial side view illustrating the connection of a lift hook to one of the chains of the lifting harness of FIG. 1.

The manner in which load bearing hooks 21 and 23 are connected to respective ends of chains 15 and 13 is shown in FIG. 4. Referring now to FIG. 4, hook 21 has a curved hook portion 31 connected by means of shank 29 to a pair of opposed aligned eyelets which are separated by a space sufficiently large to accommodate end link 25' of chain 15. A pin or bolt 33 extends through the holes in eyelets 27 and the hole in end loop 25'. Pin 33 has an enlarged head at one end and a transverse hole 33' at its other end. As shown in FIG. 1, a cotter pin 34 fits through hole 33' to retain pin 33 to prevent it from slipping out of the holes of eyelets 27. Load bearing hook 23 is attached to an end link of chain 13 in the same manner.

Figure 5:
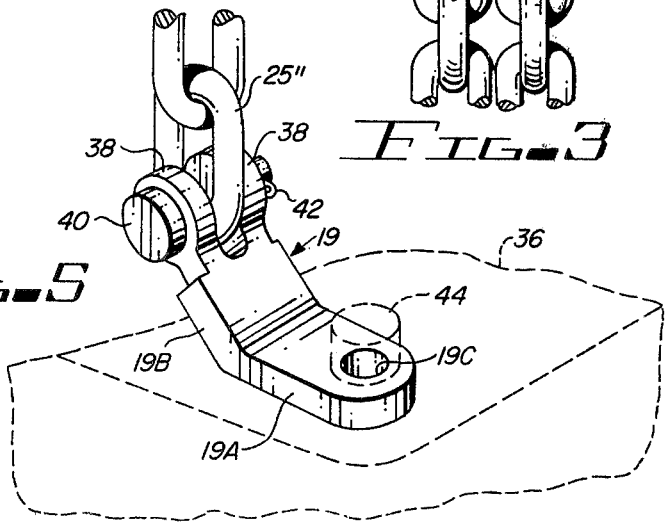
FIG. 5 is a partial perspective view illustrating use of a clevis of the lifting harness of FIG. 1 to lift a heavy object.

As shown in FIG. 5, clevises 17 and 19 are attached to the respective end links of chains 13 and 15 in a similar manner. Referring now to FIG. 5, clevis 19 has two eyelets 38 which are spaced by a distance sufficient to accommodate end link 25''. Pin 40 extends through the holes of eyelets 38 and the hole in end link 25'' and is retained in this configuration by means of cotter pin 42.

Clevis 19 has an end section with a hole 19C therein and a shank portion 19B which is angled with respect to end section 19A. Eyelets 38 extend from the free end of shank portion 19B.

In use, clevis 19 is attached to a heavy object to be lifted, such as object 36, represented in FIG. 5 by dotted lines. Object 36 has holes therein which may be threaded and into which bolt 44 is screwed. For example, if object 36 is an automobile engine, a head bolt may be removed and bolt 44 may be threaded into the head bolt hole in order to attach lift chain 15 to the engine.

Referring now to FIG. 1, it should be noted that each of load bearing chains 13 and 15 has two segments. For example, load bearing chain 15 has segment 15A which extends from the back side of chain bearing plate 3 and segment 15B which extends from the front side of chain bearing plate 3. Similarly, load bearing chain 13 has segments 13A and 13B extending from the rear and front faces of chain bearing plate 3, respectively.

It should be noted that if only two of the connecting elements (for example, load bearing hooks 21 and 23) are used, the direction of one of the chains should be reversed by drawing it completely out of chain bearing opening 7 and reinserting it in the opposite direction, so that the stressed chain segments extend out of opposite faces of chain bearing plate 3. Although this is not essential, it results in reduced stresses on the portion of chain bearing plate 3 located between elongated slots 9A and 9B, and prevents chain bearing plate 3 from tilting; this may ease unitial alignment of the lifting device (e.g., a crane or block and tackle assembly) to which lifting harness 1 is connected.

Of course, any combination of attachment of hooks and clevises can be utilized to connect the respective load bearing chains 13 and 15 to an object to be lifted. Many objects have built-in hooks designed for receiving lift hooks. Other objects have flanges and the like to which one or both of hooks 21 and 23 could be connected. If only two connecting devices (i.e., hooks or clevises) are utilized to lift a particular object, it should be noted that the orientation of the device being lifted can be controlled with more precision than is possible for prior lifting harnesses, since the length of one chain segment can be varied by engaging different links with a corresponding one of the elongated link receiving slots 9A or 9B without affecting the length of the other chain segment to which the other hook is connected.

Although many objects, such as automobile engines, transmissions, etc., are normally lifted and lowered using only two connecting points, it should be noted that lifting harness 1 can be utilized for connecting lifting harness 1 to provide three or four connecting points of a particular object to be lifted. And, of course, the device shown in FIG. 1 could be modified to provide different combinations of hooks and clevises than the combination shown. However, the combination disclosed is deemed to have greatest utility for a wide majority of lifting tasks and will satisfy most needs with no need for modification, since most heavy loads can be lifted with two connectors, usually of the same type.

Although chain bearing plate 3 is preferably formed from one fourth inch thick hot rolled steel, it can be made from any suitably strong metal or material.

While the invention has been described with reference to a particular embodiment thereof, those skilled in the art will recognize that variations to the disclosed embodiments of the invention may be made without departing from the true spirit and scope of the invention, as set forth in the appended claims.

I claim:

1. A lifting harness comprising in combination:

a. first and second load bearing chains each having first and second end links, respectively;

b. first and second hooks connected to the first end links, respectively, of said first and second load bearing chains for engaging heavy objects to be lifted by said lifting harness;

c. first and second clevises connected to the second end links, respectively, of said first and second load bearing chains, each of said first and second clevises having therein a bolt hole for receiving a bolt for attaching said first and second clevises to a heavy object to be lifted by said lifting harness; and d. a chain supporting plate composed of hot rolled steel for supporting said first and second loading bearing chains and being approximately one-fourth of an inch in thickness, said chain supporting plate having therein i. an upper hole for receiving a support hook or the like from a crane, block and tackle assembly, or the like, whereby the support hook supports said lifting harness;

ii. a lower hole through which the links of either of said first and second load bearing chains can be sequentially passed, said lower hole being separated from said upper hole by a portion of plate material of said chain supporting plate, which portion substantially strengthens said chain supporting plate;

iii. first and second link receiving slots for receiving selected links of said first and second load bearing chains, respectively, said first and second link receiving slots each opening into and extending generally downward from a lower edge of said lower hole, each of said first and second link receiving slots extending entirely through the thickness of said chain supporting plate, each of said first and second link receiving slots having a length and width which allow that link receiving slot to receive two opposed sides of the selected link and prevent either link adjacent to the selected link from being drawn through that link receiving slot said first and second link receiving slots extending radially from said substantially circular opening, said first and second link receiving slots extending at substantially equal angles from a vertical direction;

wherein said lower hole includes a substantially circular opening sufficiently large to allow at least one of said clevises or one of said hooks attached to the end links of each of said first and second load bearing chains to be drawn through said substantially circular opening to permit the first and second load bearing chains to be removed from said chain supporting plate;

said first and second clevises each including a first portion having therein one of said bolt receiving holes and a second portion inclined with respect to said first portion, the second portion being connected to an end link of one of said first and second load bearing chains;

whereby an object to be lifted can be connected to said lifting harness by means of either clevises or hooks, and whereby the orientation of the object to be lifted can be controlled by appropriately selecting which link of each load bearing chain is placed into the first and second load receiving slots, respectively.

2. The lifting harness of claim 1 wherein said first and second hooks and said first and second clevises each include a pair of aligned spaced eyelets for hingably connecting said first and second hooks and said first and second clevises to said end links by means of pins or bolts extending through said eyelets and said respective end links.

* * * * *